US005377808A

United States Patent [19]

Baer et al.

[11] Patent Number: 5,377,808

[45] Date of Patent: Jan. 3, 1995

[54] MOTOR DRIVEN DOOR RELEASE LATCH

[75] Inventors: Scott D. Baer; Douglas W. Woycheshin, both of Shiner, Tex.

[73] Assignee: Kaspar Wire Works, Inc., Shiner, Tex.

[21] Appl. No.: 88,402

[22] Filed: Jul. 6, 1993

Related U.S. Application Data

[63] Continuation of Ser. No. 799,381, Nov. 27, 1991, abandoned.

[51] Int. Cl.[6] ..... G07F 11/04

[52] U.S. Cl. ..... 194/216

[58] Field of Search ..... 194/217, 218, 219, 223, 194/216; 221/153, 12

[56] References Cited

U.S. PATENT DOCUMENTS 3,549,045 12/1970 Rosenhagen ..... 221/12
3,901,366 8/1975 Schuller et al. ..... 194/210
4,369,800 1/1983 Watanabe et al. ..... 453/32
4,386,691 6/1983 Voegeli ..... 194/220
5,036,966 8/1991 Kaspar et al. ..... 194/217
5,060,777 10/1991 Van Horn et al. ..... 194/346 X
5,096,088 3/1992 Grossi ..... 221/153 X

*Primary Examiner*—F. J. Bartuska
*Attorney, Agent, or Firm*—Gunn, Lee & Miller

[57] ABSTRACT

A motor-driven door release mechanism for an electronic totalizer of a coin-receiving mechanism operatively associated with a newspaper vending machine. The motor is energized by a power supply acting through a totalizer control board and is disengaged upon rotation to a predetermined position by a rotor arm connected to the armature of the electric motor to disable the current line from the totalizer control board to the motor. Approximately simultaneously with disengaging the motor, a lift arm attached to the rotor arm releases the door latch control of the newspaper vending machine.

7 Claims, 5 Drawing Sheets

MOTOR DRIVEN DOOR RELEASE LATCH

This is a continuation of copending application(s) Ser. No. 08/799,381 filed on Nov. 27,1991 now abandoned.

Field of the Invention

This invention relates to an electronic coin control mechanism which operates the latch to a door accessible cabinet of a newspaper vending machine, more specifically, this invention relates to a motor-driven latch release for the door to the newspaper rack.

BACKGROUND

Traditionally, newspaper vending machines have been comprised of a cabinet for enclosing a stack of newspapers, the cabinet accessible through a latch-operated, hinged door. A mechanical coin control mechanism for accepting and totalizing coins, releases the latch securing the door, when the coins reach the total denomination required for that day's edition of the newspaper.

Recently, electronic totalizers have been introduced into the field of newspaper vending machines. The function of the electronic totalizer is to electronically sense the denomination of the coins deposited through the slot of the newspaper vending machines and, among other functions, to send an appropriate signal to the latch-release mechanism when the coins reach a predetermined maximum representing that day's price for the newspaper.

The electronic signal must be converted into mechanical motion to release the latch securing the door of the newspaper cabinet. In the past, the conversion of the electronic signal into mechanical motion has been performed by a solenoid. For example, U.S. Pat. No. 5,036,966, the specifications and drawings of which are incorporated herein by reference, discloses in FIG. 8 solenoid (140) which pulls upwardly when electronic power is applied to release the latch.

Applicant has found that the use of a small, D.C.-powered 2.0 volt (minimum) electric motor will provide the same amount of movement to operate the latch release mechanism, but draw less current. The result is a significant increase, as compared to a solenoid operated release mechanism, in the useful life of the power supply. Applicant has found that when the motor is placed in series with a limit or home switch which is located to cut off power to the motor and prevent a lock-up condition, a maximum D.C. current of approximately 75 milliamps is required during the unlock pulse. This compares to 380 milliamps of a solenoid operated latch release mechanism. Both require about 250 milliseconds to affect the necessary movement.

Applicant's experiments determined that the unlock pulse draws approximately 75% of the battery power over the expected normal life of their TK-Electronic R model mech. According to Applicant's calculations, the resulting expected battery life increases from 12–18 months for the solenoid operated unlock mechanism to 24–36 months for the motorized latch unlock mechanism. Moreover, the solenoid has been difficult to adjust in production and its operation may vary over the life of the mechanism. In addition, the cost of the motorized latch release mechanism is about one-half that of the solenoid operated latch mechanism. Thus, using the electric motor-driven latch release as compared to the solenoid-driven latch release can represent a substantial increase in the useful life of the D.C. power supply operating the electronic coin control mechanism. This is especially important in that the environment in which most of the newspaper vending machines operate is one that does not have ready access to a remote power source such as an AC outlet and therefore, the racks must have their own internal power supply.

It is an object of the present invention to provide a retrofit motor-driven latch mechanism for newspaper vending racks as identified and set forth in U.S. Pat. Nos. 3,738,466, 3,882,984, 3,946,848, 4,000,799, and 4,037,701.

These patents set forth newspaper vending rack mechanisms and particularly set forth systems which are able to vend at variable prices. The inclusion of an electronic totalizer means in the mechanical coin control mechanism provides for the removal of some but not all of the mechanical environment. Specifically, the introduction of an electronic totalizer allows for the removal of a mechanical totalizing means, but leaves the mechanical environment which provides for the latch release mechanism, the escrow tray, and the coin release/coin return mechanism.

It is another object of this invention to provide for an electronic coin control mechanism for a newspaper vending machine which provides for an electrically operated motor to disengage the latch mechanism securing the door to the cabinet of the newspaper rack.

It is another object of the present invention to provide for a retrofit motor-driven latch mechanism for a newspaper vending machine which is activated by a pulse from the electronic totalizer and deactivated by a series mounted switch which de-energizes the motor when contacted by an armature mounted rotor arm.

It is another object of the present invention to provide for a retrofit motor-driven latch mechanism for a newspaper rack, the motor of which is energized by a pulse whose duration is electronically determined.

SUMMARY OF THE INVENTION

The objects of the present invention are met by providing a newspaper vending rack with a closed paper receiving cabinet, a coin box installed with a rack, a hinged door on the cabinet, a protruding door hook for closing the door of the cabinet, a closed coin receiving housing supported by the cabinet, a door hook closure means cooperatively latching the door hook on closure of the door hook, an electronically powered coin measuring means mountable inside of the housing, a motor-driven means operatively connected to the coin measuring means for releasably engaging the door hook to permit opening of the door, limit switch connected in series with the motor-driven means and located proximate to the motor-driven means and an electronic power supply connected to the coin measuring means, the combination such that energization of the motor-driven means provides movement to the motor-driven means ultimately causing contact with said switch and the energization of the motor means. As you may have noted, that was taken for the most part from claim 10.

BRIEF DESCRIPTION OF THE FIGURES

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Please note that for ease of understanding, applicant has maintained the same numerals and terms as provided for in the '966 patent, with newly added structure beginning with the numeral 210.

Figure 2:
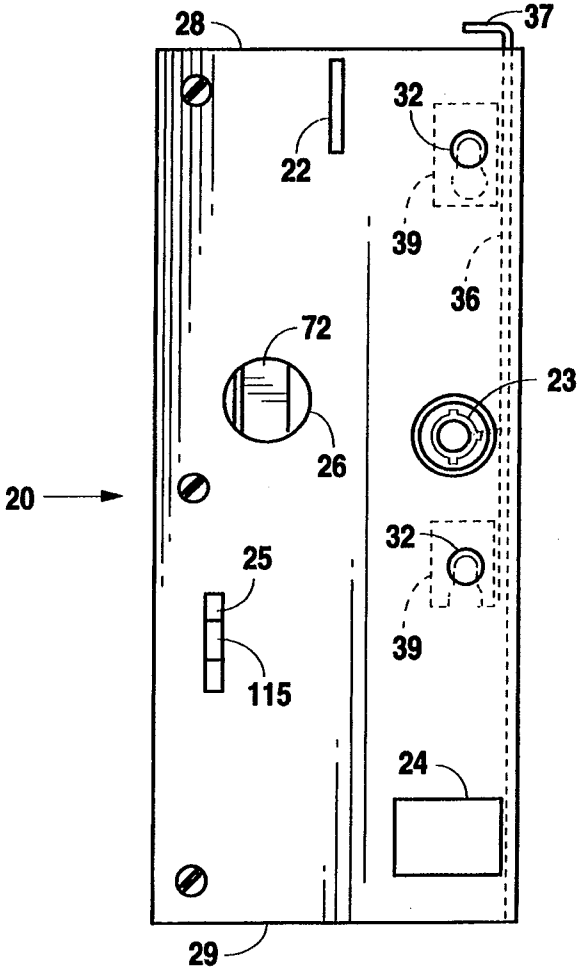
Fig. 2 (PRIOR ART)
FIG. 2 is a front view of a removable retrofit coin mechanism in accordance with the present disclosure.
Figure 1:
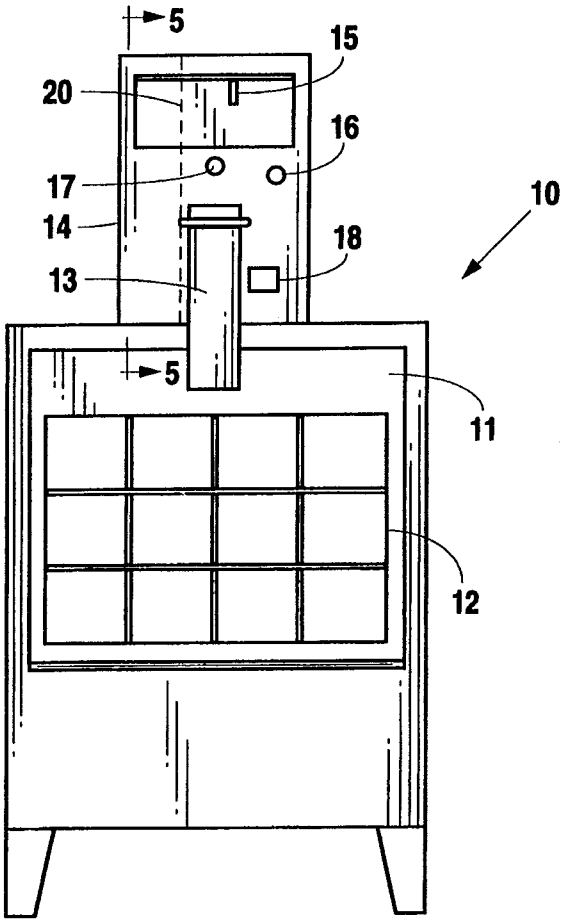
Fig. 1 (PRIOR ART)
FIG. 1 is a front view of the newspaper vending rack having a closed paper receiving cabinet with a front door and a housing on the top for receiving the invention of the present disclosure.

Attention is directed first to FIGS. 1 and 2 provided as background and considered jointly for a description of the context in which the present apparatus is used. This context incorporates a newspaper vending rack which is identified generally by the numeral (10). It is a closed housing having a hinged front door (11) which opens to vend newspapers. It has a visible window, typically covered with a transparent material, and the window (12) normally has a set of bars across it for security, and a newspaper is often displayed in that area. The door (11) supports a closure bar (13) which extends upwardly. That is positioned in front of or immediately adjacent to a closed housing (14) which is made of heavy duty sheet metal and which is closed on all sides. This housing has several features which need to be noted. Among these features, the housing includes a coin insertion slot (15). In addition to that, there is a key operated switch (16). It is provided so that service personnel can switch the vending machine retrofit apparatus to be described between prices, for example, the Sunday price versus the daily newspaper price. There is additionally a coin return button (17) so that a purchaser can operate that button and thereby obtain return of the coins through the return slot (18). At least to this extent, this is the structure that has existed for several years, and is the structure for which the present disclosure provides a retrofit mechanism to drive the latch release operating the door of the cabinet.

The mechanism identified generally at (20) in FIG. 2 of the drawings which will be described in very general terms hereinafter as the coin mechanism which is an electronically driven device. The mechanism (20) thus installs inside the housing (14). It does not fill the entire structure and to this end, is shown in dotted line at (20) in FIG. 1. It has a front face (21) which aligns with the coin slot (15), the key operated switch (16), and a return slot (18). The coin reject button (17) also operates with the mechanism (20) as will be described.

Going now to the structure of FIG. 2, it is a generally rectangular structure. It is equipped with the front face (21) as illustrated. It also has a coin slot (22) which aligns with the coin slot (15) when installed. The key switch is illustrated at (23), and the coin return slot (24) is likewise illustrated. An important feature is the narrow rectangular slot at (25) which is provided for the door hook. Above that, there is round hole (26) to enable the coin return push button at (17) to extend through the front panel (21). It operates a bar which is shown in FIG. 2 but which will be detailed substantially hereinafter.

In general terms, the coin mechanism (20) is a rectangular box. Thus it has the described front face (21). It is also provided with a top cover at (28), a separate bottom plate (29) and a side plate (30). The coin mechanism (20) is installed in the larger housing (14) which is shown in FIG. 1. The housing (14) is constructed so that it can be opened to provide access to the vault (inside the housing) where the money is received and stored. The vault must be opened periodically so that the money can be removed and to this end, easy internal access is obtained for the housing (14).

With FIGS. 1 and 2 providing the general environment of the present invention, we turn now to the particulars of the present invention.

Figure 3:
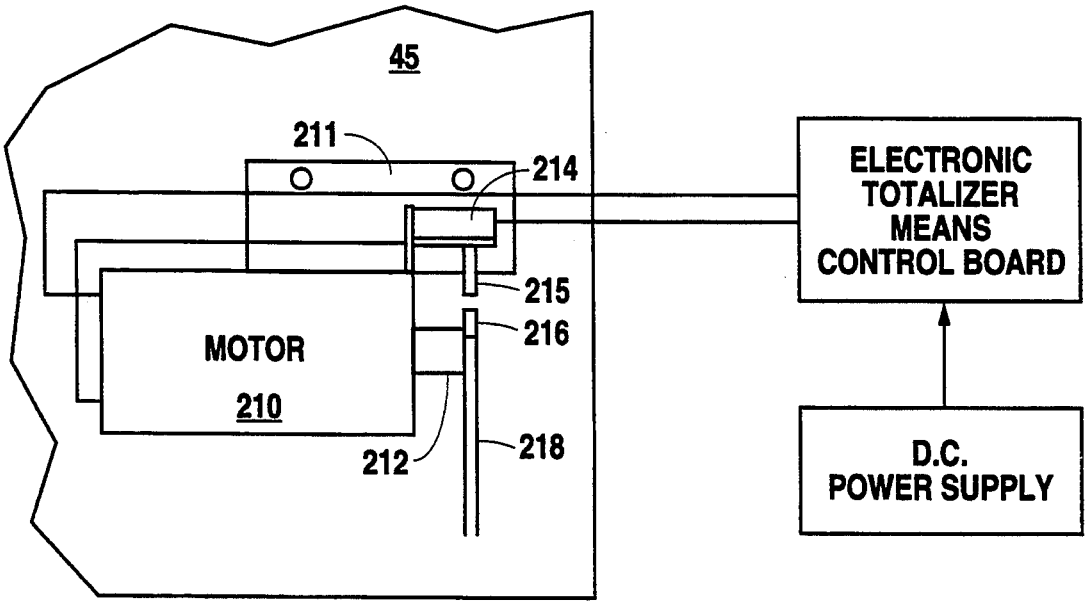
FIG. 3 combines a flow-chart showing the application and distribution of current and electronic signals in the newspaper vending machine to the mechanical embodiment having an electric motor and a switch.
Figure 4:
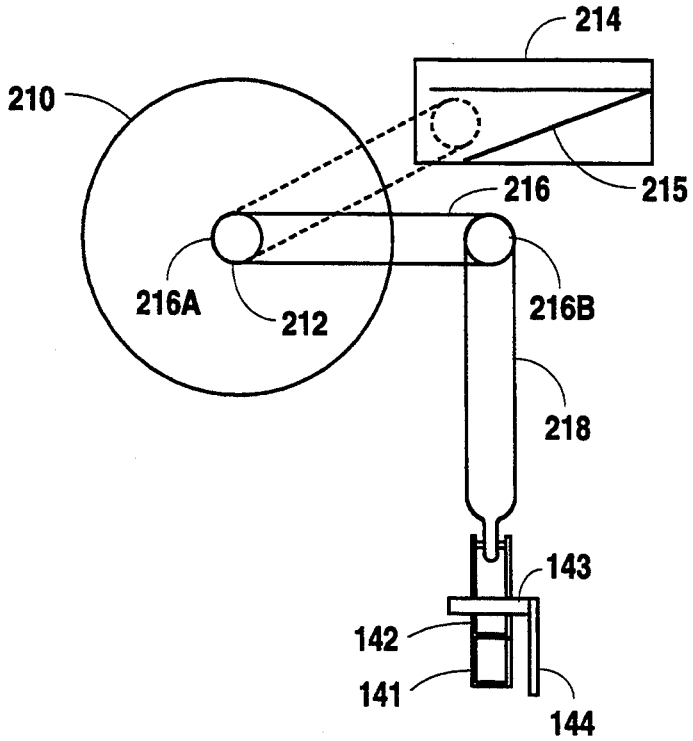
FIG. 4 illustrates in elevational view the motor interfacing with a switch and the mechanical environment to provide for a release of the latch securing the door to the newspaper cabinet.

FIGS. 3 and 4 disclose a motor (210) mounted by bracket (211) to side wall (45), the motor having an armature (212) extending therefrom. Mounted to either motor (210) or side wall (45) is home switch (214) connected in series with motor (210) with reed (215) depending therefrom. Rigidly mounted at a first end (216*a*) to the removed end of armature (212) is switch activation rotor arm (216), mounted so as to rotate therewith and with a second end (216*b*) from which depends lift arm (218).

Turning back to FIG. 3, it may be seen how power supply (180) supplies power to CPU or electronic totalizer means control board, which provides the electronic coin control mechanism with a means for receiving the signals from the electronic coin acceptor, from the variable price change means, if any, and from any other source, such as data collection information regarding time of sale, etc., as more specifically set forth in the '966 patent, and to process the signal such that the mechanical environment reacts appropriately. More specifically, FIG. 3 illustrates a D.C.-powered CPV or electronic totalizer means control board which receives signals from the electronic coin acceptor to provide current to motor (210).

Turning now to FIG. 4, it can be seen that motor (210) has mounted on armature (212) thereof switch activation rotor arm (216) and mounted in such a fashion that rotor arm (216) rests in a plane generally horizontal to that of the ground with reed (215) of on-off switch (214) resting in close proximity to the removed end of switch activation arm (216). Thus, upon energizing motor (210), rotor arm (216), urged by the rotation of armature (212), will rotate upwards until it engages reed (215) of home switch (214) which closes as rotor arm (216) continues rotation until switch (214) de-energizes motor (210). Thus switch (214) acts as a limit switch, being wired in series with motor (210) to deenergize the same. Upon such deenergization of motor (210), rotor arm (216) will fall back to its generally horizontal position where lever (141) rests against stop (220). Stop (220) is rigidly mounted to side wall (45) in such a position so as to provide for sufficient distance of rotational travel of rotor arm (216) which, when translated into linear movement through lift arm (218) represents about the distance between shoulder (142) of lever (141) and tab (143) of bent arm (144).

Figure 5:
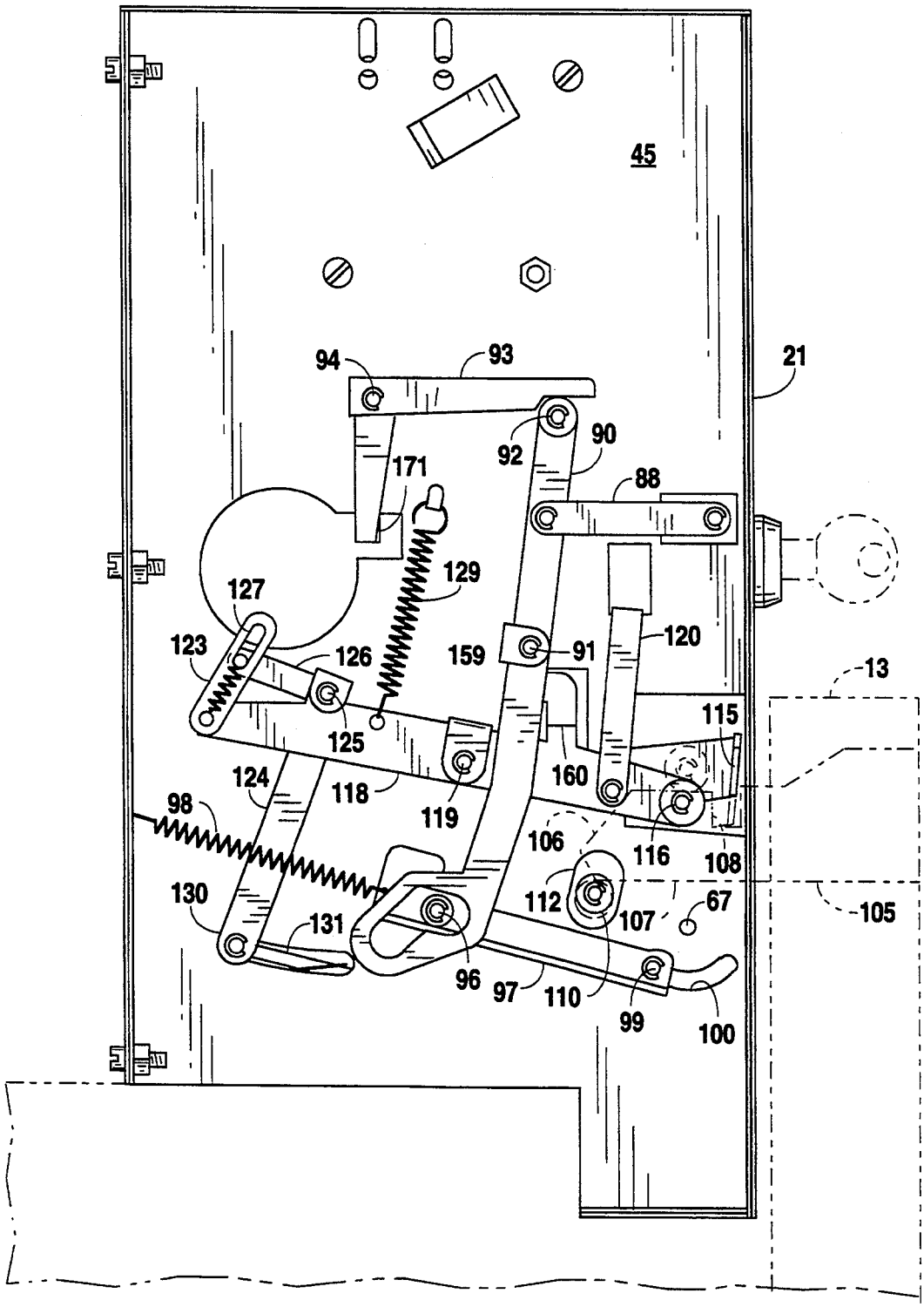
Fig. 5 (PRIOR ART)
FIG. 5 illustrates a side elevational view of the latch and the release mechanisms associated therewith.
Figure 6:
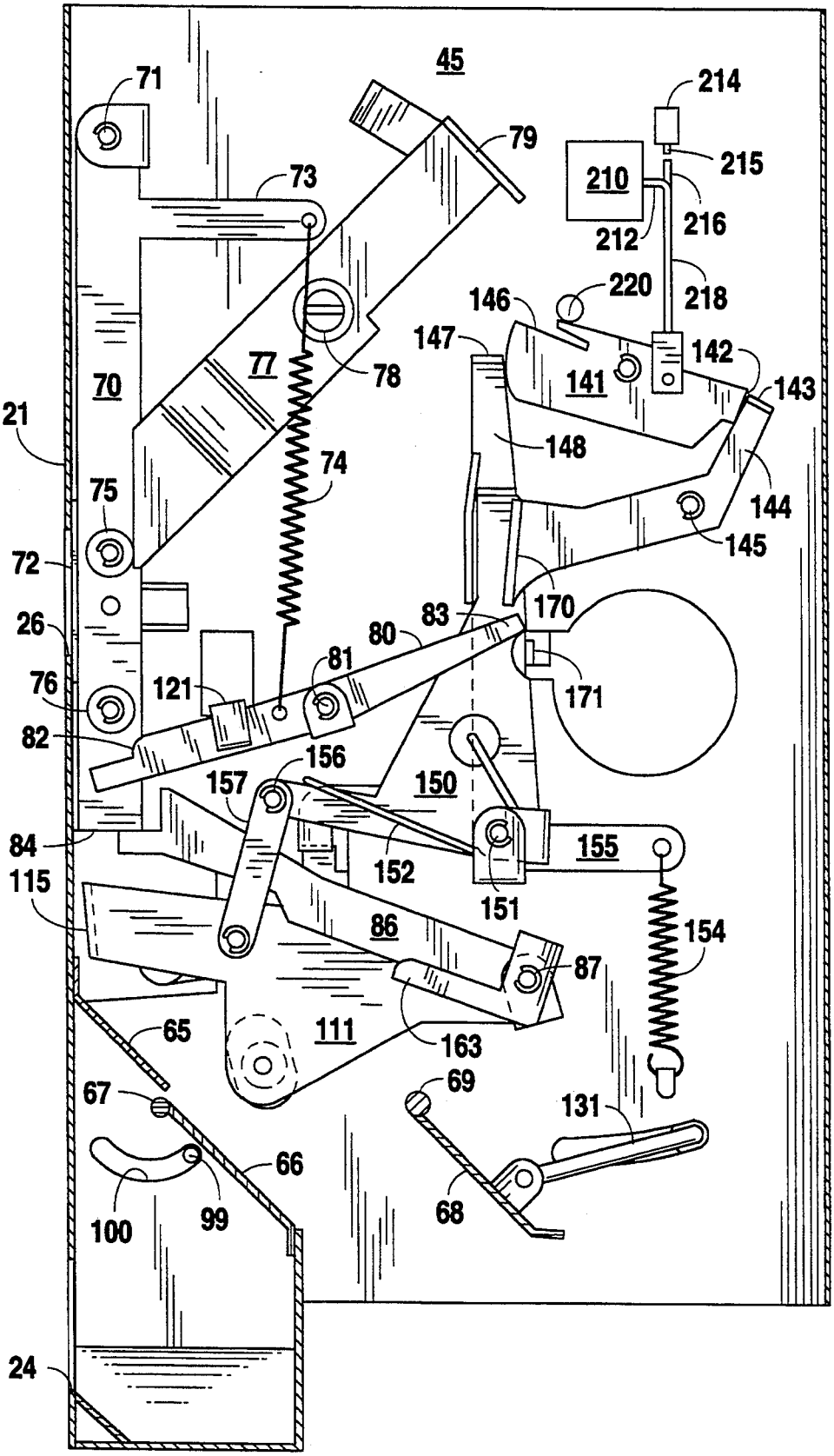
FIG. 6 illustrates a side elevational view of the electric motor of the present invention operating in a mechanical environment to provide for a release of the latch securing the door to the newspaper rack.

Attention is now directed to additional components of the system shown in FIGS. 5 and 6 of the drawings, although it is noted that with the exception of stop (220) these components are not novel to the present disclosure. Motor (210) pulls upwardly when electrical power is applied and rotates a lever (141). Lever (141) normally at rest against stop (220) and includes shoulder (142) which selectively engages tab (143) below the shoulder (142). Tab (143) is affixed to a bent arm (144) mounted on pivot (145) and rotatable through a few degrees of rotation. The lever (141) additionally includes another top located shoulder at (146), and that is located to engage the hook tab (147) immediately adjacent thereto. The tab (147) is on the long arm (148). The arm (148) supports a pair of confining tabs (149) which control the relationship of the arm (144) and the arm (148).

The arm (148) is part of a T-bar (150) which is a unitary structure which is preferably formed of two or more pieces of metal. The T-bar rotates on a pivot (151) and torsion spring (152) creates a torque keeping the two separate pieces of the T-bar together so it forms a single unit. It has the appearance of an inverted T as shown in FIG. 6, and at one end, a coil spring (154) is connected to an appended arm (155). The opposite extremity is pivotally connected at (156) to a link bar (157) and that is connected to a lock arm (111) so that the two must rotate in unison. The T-bar supports a downwardly protruding tab (159) which is folded to extend through the mounting plate (45) and to engage a cooperative tab (160) (see FIG. 5). The tabs (159) and (160) shake hands, so to speak, through an opening cut in the mounting plate (45). The lever (86) is in the position to lock the coin reject bar (70); it is supported on the pivot (87) and is integrally constructed with the protruding arm (163).

Other interlocks shown in FIG. 6 of the drawings need to be noted. The lever (80) has a tip (83) which is prevented from rotating excessively upwardly by the upstanding tab (170). In addition to that, the tab (171) (FIG. 4) is supported on the arm of the L-shaped bell crank (93) rotating about the pivot (94) (see FIG. 5).

LATCH HOOK ENGAGEMENT/DISENGAGEMENT FOR VENDING A NEWSPAPER

The ordinary condition of the door hook (105) is the dotted line position shown in FIG. 5 of the drawings where the door hook is fully held against opening. In this condition, the door hook has pressed the roller (110) downwardly to the dotted line position seen in the drawings. When that moves down, it connects to the lock arm (111) and pulls the hook (115) downwardly into the door hook notch (108) and holds the door hook fast. Thus, it is not possible to strong arm the door open. In operation, the roller (116) moves independently of the roller (110). So to speak, the two rollers catch on the top and bottom edges respectively of the door hook. The roller at the top is forced upwardly, rotating the bar (118) in a counterclockwise rotation and setting the equipment to hold the door hook and provide position indication of its engagement.

The door must be unlatched to vend the paper. This is accomplished substantially in the fashion set forth in the Knickerbocker U.S. Pat. No. 4,037,701 wherein the roller (116) is moved upwardly. Release for opening to vend a newspaper is triggered by determining that the correct amount of money has been paid, whereupon a sales transaction is permitted to occur. The door is released by disengaging the door hook and the door hook can then be retracted from the dotted line position of FIG. 5 to be fully outside the coin mechanism (20). Simultaneously, the rollers (110) and (116) are positioned for return of the door hook when it is slammed shut after selling the newspaper. Moreover, this sequence is involved with operation of the motor (210) which through lift arm (218) makes a short stroke upwardly to achieve opening, and that motion in turn is coupled to the arms (144) and (148) which are initiated in operation by the motor (210).

Figure 7A:
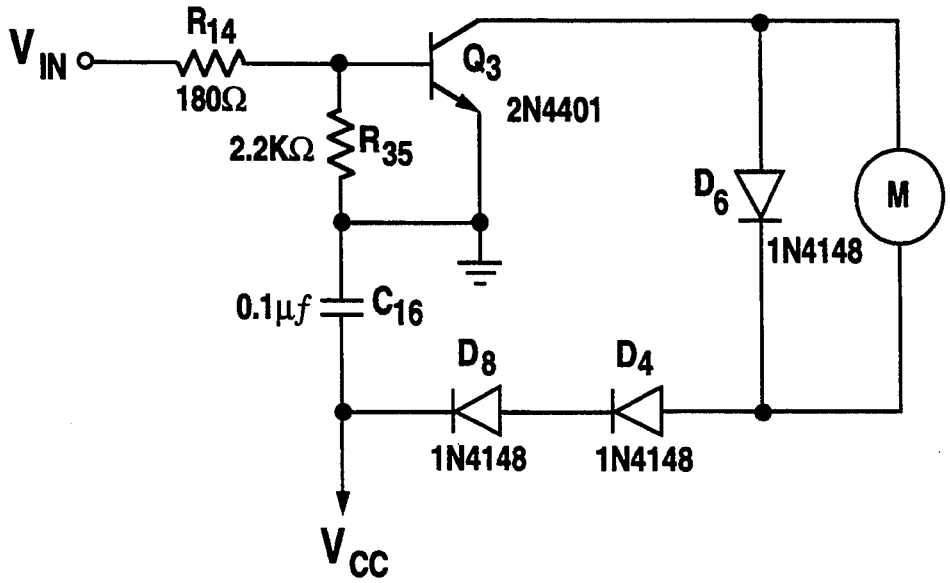
FIG. 7*a* and 7*b* illustrate an electronic circuit to control pulse duration.

FIG. 7A illustrates the circuit used with the first motor driven unlatch mechanism. This is the same circuit that powered the solenoid disclosed in the '966 patent, except with a motor swapped for the solenoid. Applicant found, however, that use of a D.C. motor in place of the solenoid but with the same TTL signal from the COPS processor caused a marked current draw (and power loss) when the mechanical linkage of the D.C. motor "hung up" at its physical limit. To solve this, applicants provide a small RC circuit to limit the time of the unlock pulse from the COPS processor.

Figure 7B:
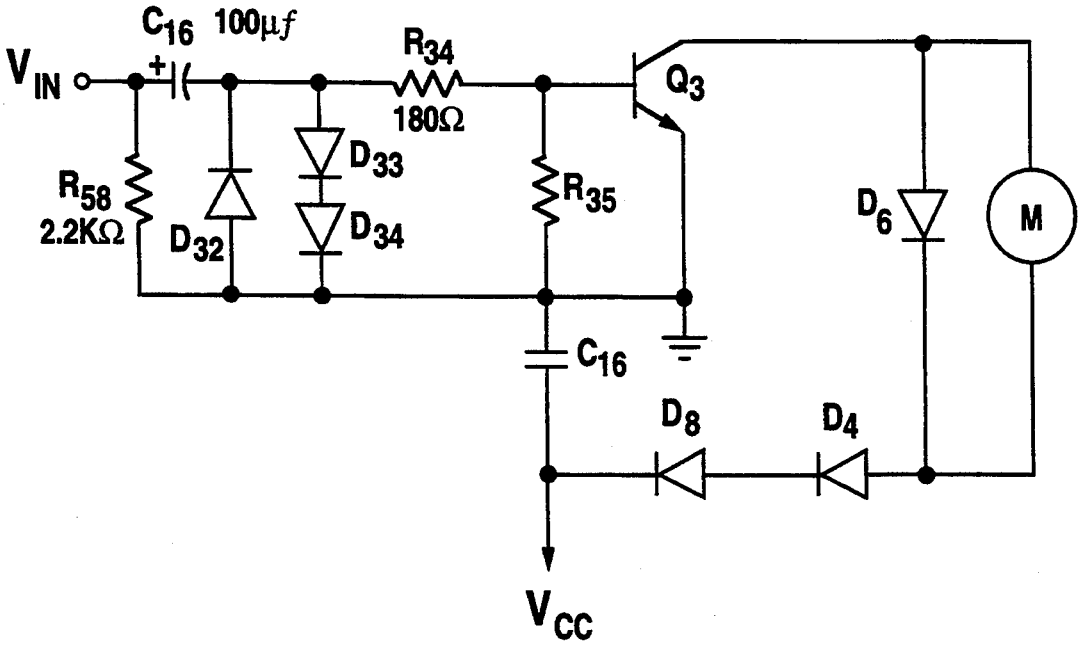

FIG. 7B. This circuit works properly to provide a timed unlock pulse, however, it requires modification of the original circuitry illustrated in FIG. 7A. Additionally, due to cold temperatures, moisture or low battery state the pulse provided may prove inadequate in duration and/or strength to provide the necessary physical movement of the rotor arm. The elements and values of the circuit are noted as follows:

| Symbol | Device | Value |
|---|---|---|
| Vin, Vcc | DC power input power | +5 VDC for about 280 millisec |
| $R_{58}$ | Resistor | 2.2K ohm |
| $R_{34}$ | Resistor | 180 ohm |
| $C_{20}$ | Capacitor | 100 microfarads |
| $C_{16}$ | Capacitor | 0.1 microfarads |
| $D_4$, $D_6$, $D_8$ $D_{32}$, $D_{33}$, $D_{34}$ | Diodes | 1N4148 |
| M | DC motor | 2.0 volt minimum generally 2.0–5.0 V |
| $Q_3$ | Transistor | 2N4401 |

Thus, applicant has provided for a motor driven latch release mechanism for operating a door providing access to a newspaper cabinet. More importantly, applicant has provided a motor-driven mechanism that provides significantly reduced power consumption and greater battery life than the solenoid operated latch release mechanism. Moreover, applicant has provided a limit switch means or an electronic means to limit the duration of the current driving the motor of the latch release mechanism. Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

I claim:

1. A newspaper vending rack having a coin box installed which rack and coin box, after coin box installation, includes:

a closed paper receiving cabinet;

a hinged door on said cabinet;

a protruding door hook for closing said door;

a closed coin receiving housing supported by said cabinet;

door hook closure means cooperatively latching said door hook on closure thereof, said door hook closure means comprising:

lever mechanism means capable of alternately latching and releasing said door hook;

spring means tending to position said lever mechanism means so as to release said door hook; and latch setting means capable of setting said door hook closure means in a position against said spring means so as to prevent release of said door hook;

an electrically-powered coin measuring means mountable inside said housing;

motor-driven rotary motion means, operatively controlled by said coin measuring means for repositioning said door hook closure means to permit release of said door hook and to thereby permit opening of said door; and an electric power supply operatively connected to said coin measuring means to power said motor-driven means when coins received in said electrically-powered coin measuring means reach a predetermined total;

wherein said coin measuring means momentarily energizes said motor-driven means to release said door hook.

2. The device of claim 1 further including a limit switch, said limit switch connected in series with said motor-driven means and located proximate to said motor-driven means such that energization of said motor-driven means provides rotational movement to said motor-driven means causing contact with said switch and de-energization of said motor means, wherein said de-energization occurs after said door hook closure means has been repositioned by said motor-driven means.

3. The device of claim 2 wherein said motor-driven means is a D.C. motor operating on approximately 2.0 volts minimum voltage and which D.C. motor draws current only when energized.

4. The device of claim 3 wherein said motor-driven means has a rotor arm mounted to an armature thereof, said rotor arm for moving upon energization, from a position disengaged from the switch to a position engaging switch, such engaging position allowing the switch to de-energize the motor.

5. The device of claim 4 further including a means for selectively locating the rotor arm in the disengaged position.

6. The device of claim 1 further comprising a means to electronically control the duration and strength of the current supplied to said motor-driven means so that energy is provided to said motor-driven means of sufficient strength and duration to position said door hook closure means so as to release said door hook.

7. A newspaper vending rack having a coin box installed which rack and coin box, after coin box installation, includes:

a closed paper receiving cabinet;

a hinged door on said cabinet;

a protruding door hook for closing said door;

a closed coin receiving housing supported by said cabinet;

door hook closure means cooperatively latching said door hook on closure thereof, said door hook closure means comprising:

lever mechanism means capable of alternately latching and releasing said door hook;

spring means tending to position said lever mechanism means so as to release said door hook; and latch setting means capable of setting said door hook closure means in a position against said spring means so as to prevent release of said door hook;

an electrically-powered coin measuring means mountable inside said housing;

motor-driven rotary motion means, with an arm extending therefrom operatively controlled by said coin measuring means for repositioning said door hook closure means to permit release of said door hook and to thereby permit opening of said door;

a limit switch, said limit switch connected in series with said motor-driven means and located proximate to said motor-driven means such that energization of said motor-driven means provides rotational movement to the arm of said motor-driven means, the movement causing the arm to contact with said switch and deenergize said motor means, wherein said de-energization occurs after said door hook closure means has been repositioned by said motor-driven means; and an electric power supply operatively connected to said coin measuring means to power said motor-driven means when coins received in said electrically-powered coin measuring means reach a predetermined total.

* * * * *